US012520934B2

(12) United States Patent
Samikkannu

(10) Patent No.: US 12,520,934 B2
(45) Date of Patent: Jan. 13, 2026

(54) MOBILE MOTORIZED FOLDING TABLE

(71) Applicant: AmTab Manufacturing Corporation, Bensenville, IL (US)

(72) Inventor: Steven M Samikkannu, Arlington Heights, IL (US)

(73) Assignee: AmTab Manufacturing Corporation, Bensenville, IL (US)

( * ) Notice: Subject to any disclaimer, the term of this patent is extended or adjusted under 35 U.S.C. 154(b) by 187 days.

(21) Appl. No.: 18/368,561

(22) Filed: Sep. 14, 2023

(65) Prior Publication Data

US 2025/0089887 A1 Mar. 20, 2025

(51) Int. Cl.
*A47B 3/14* (2006.01)
*A47B 3/00* (2006.01)

(52) U.S. Cl.
CPC ..... *A47B 3/14* (2013.01); *A47B 3/002* (2013.01); *A47B 2003/145* (2013.01); *A47B 2200/0037* (2013.01); *A47B 2200/0056* (2013.01)

(58) Field of Classification Search
CPC ..... A47B 3/14; A47B 3/002; A47B 2003/145; A47B 2200/0056; A47B 39/06; A47B 83/02
USPC ..... 297/362.14
See application file for complete search history.

(56) References Cited

U.S. PATENT DOCUMENTS 7,458,638 B1 * 12/2008 Frank ..... A47C 3/24 297/344.14
8,205,937 B2 6/2012 Rivera, Jr. et al.
8,479,667 B2 7/2013 Rivera, Jr. et al.
2006/0042524 A1 3/2006 Rios et al.
2016/0037904 A1 2/2016 Wu

OTHER PUBLICATIONS

Confair Folding Table with Electric Motor—Child's Play to Handle, Publication Date: Apr. 5, 2017 https://blog.wilkhahn.com/e-confair-folding-table-video/ The video if the non-patent literature is currently not available at the Wilkhahn.com blog. It has been found at https://www.facebook.com/admodumfurniture/videos/e-confair-folding-table-by-wilkhahn/1833285896996049/.

* cited by examiner

*Primary Examiner* — Milton Nelson, Jr.
(74) *Attorney, Agent, or Firm* — HONIGMAN LLP

(57) ABSTRACT

A motorized assembly for a mobile folding table transitions the folding table between a folded position and an unfolded position. The folding table includes a first table section hingedly connected to a second table section to permit folding and unfolding the table about a horizontal hinge axis between the folded position and the unfolded positions. Links connected to the first and second table sections are configured to articulate with the folding and unfolding of the table. The motorized assembly is connected to the links and includes an upper tube connected to a receiver member that moves the upper tube from the receiver member between an extended position that causes the table sections to fold and a contracted position that causes the table sections to unfold.

18 Claims, 9 Drawing Sheets

MOBILE MOTORIZED FOLDING TABLE

TECHNICAL FIELD

This disclosure is generally directed to mobile folding tables. More specifically, it relates to mobile folding tables having a motorized assembly for folding and unfolding the table.

BACKGROUND

Mobile folding tables are useful in school cafeterias and other institutional settings, as they have the potential to be versatile and allow for fast setup and removal, as well as being compact when folded for convenient storage. However, existing folding tables typically have heavy table tops and are therefore difficult to lift from an unfolded use position to a folded storage position. Moreover, in folding tables with attached bench seating, the benches add further weight to the assembly making it difficult for maintenance personnel to unfold the table for use and to fold the table for storage.

It would be advantageous to provide a motorized folding table that can be operated by maintenance personnel for unfolding the table for use and folding the table for storage.

SUMMARY

This disclosure relates to mobile folding tables having a motorized assembly for folding and unfolding the table.

The mobile motorized folding table is adapted to transition between a folded position and an unfolded position. The mobile motorized folding table comprising a first table section hingedly connected to a second table section to permit folding and unfolding the table about a horizontal hinge axis between the folded position and the unfolded position with the first and second table sections substantially vertical in the folded position and the first and second table sections substantially horizontal in the unfolded position. Links are connected to the first and second table sections and configured to articulate with the folding and unfolding of the table. A motorized assembly is connected to the links that includes an upper tube connected to a receiver member for relative movement of the upper tube from the receiver member between a first position that causes the table sections to fold and a second position that causes the table sections to unfold.

The motorized assembly includes an electrical motor mechanically connected to the upper tube assembly and electrically connected to a switching device and to a source of electrical power. The switching device is operated to connect the motor to electrical power at a first polarity from the source of electrical power causing the motor to drive the upper tube into the first position and the table sections into the folded position. Alternately, The switching device is operated to connect the motor the electrical power at a second polarity from the source of electrical power causing the motor to drive the upper tube into the second position causing the table sections into the unfold position.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

The figures discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
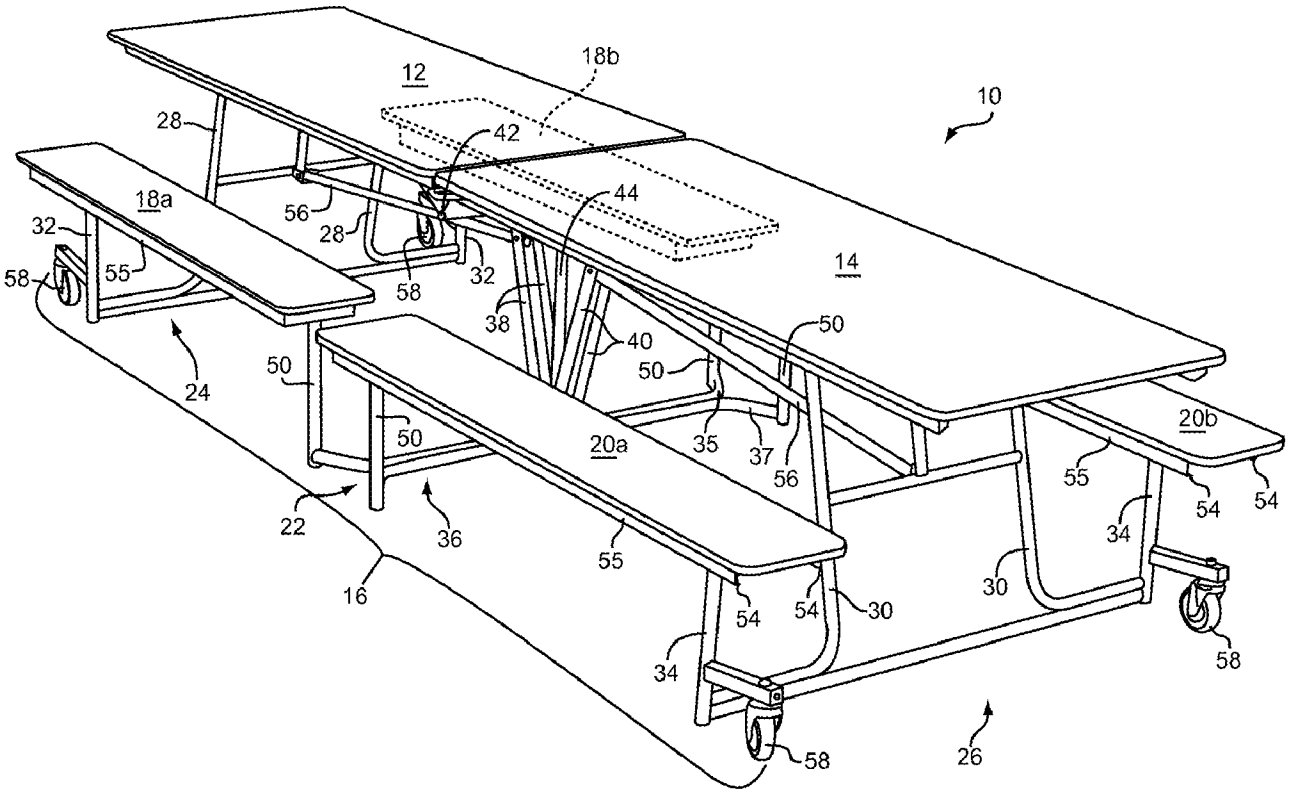
FIG. 1 is a perspective view of the mobile folding table shown in an unfolded use position according to the disclosure.
Figure 2:
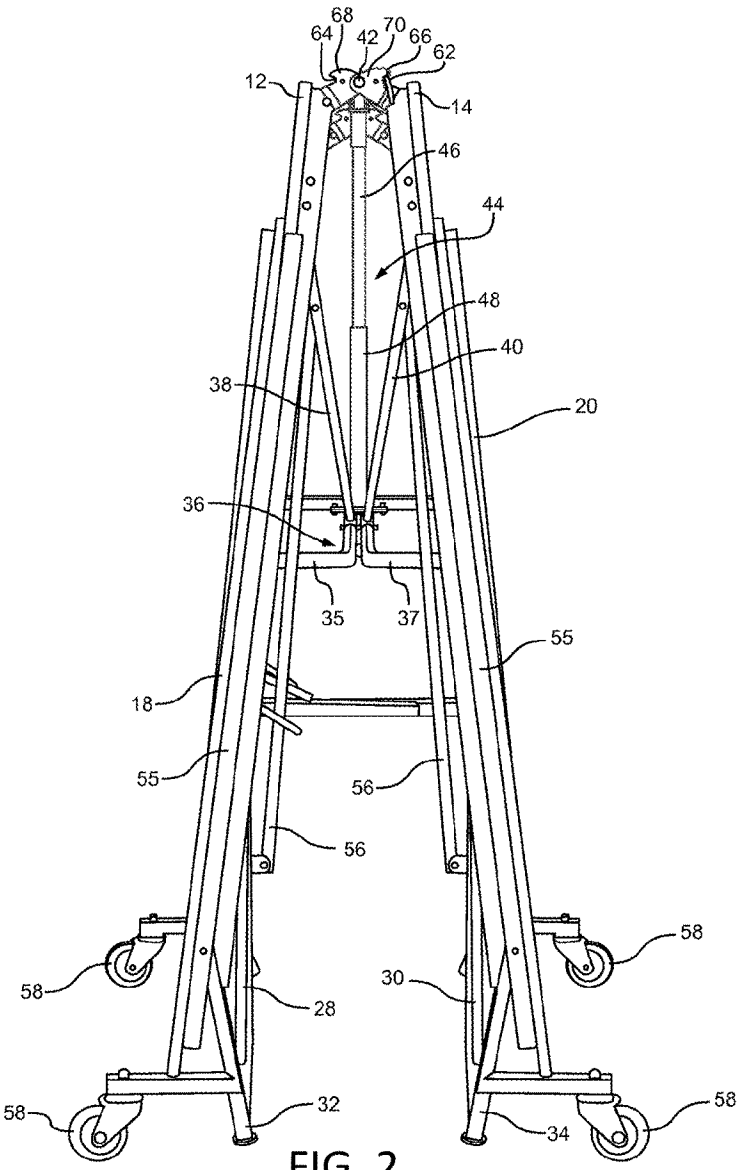
FIG. 2 is a side perspective view of the mobile folding table of FIG. 1, shown in a folded storage position according to the disclosure.

With reference to FIG. 1, a mobile folding table 10 according to the disclosure is illustrated in its unfolded use configuration. Table 10 includes hinged connected table top halves 12 and 14, a frame 16, and benches 18 and 20. Table 10 is supported by frame 16, whose center portion 22 and end portions 24 and 26 also include the folding linkage permitting table 10 to be folded into the storage position as illustrated in FIG. 2.

Figure 3:
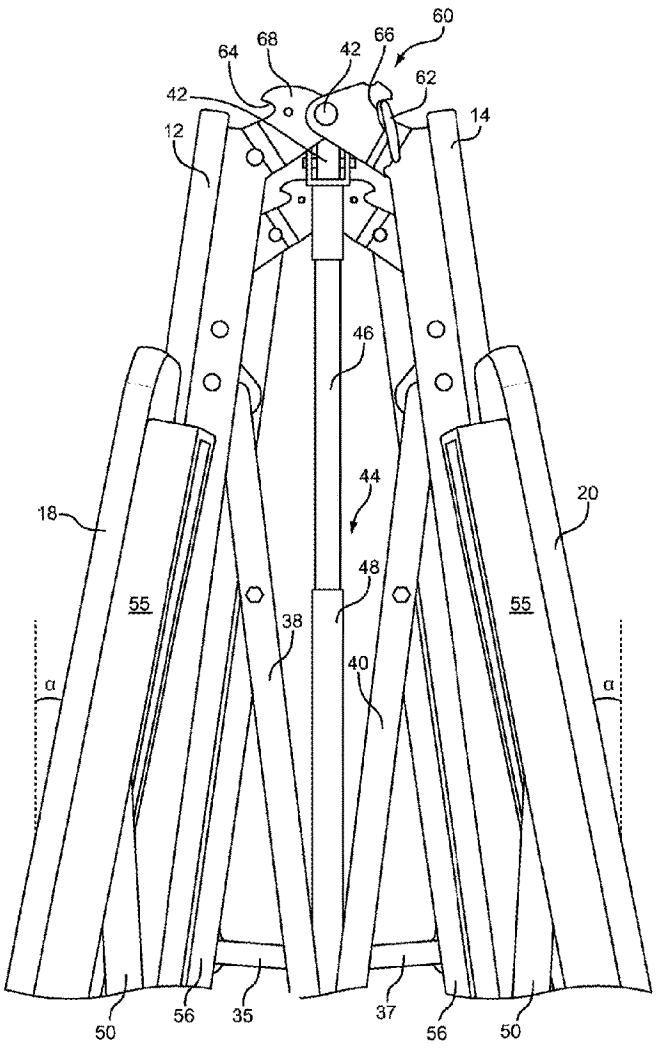
FIG. 3 is a side perspective view of a center portion of the mobile folding table of FIG. 1 according to the disclosure.
Figure 4:
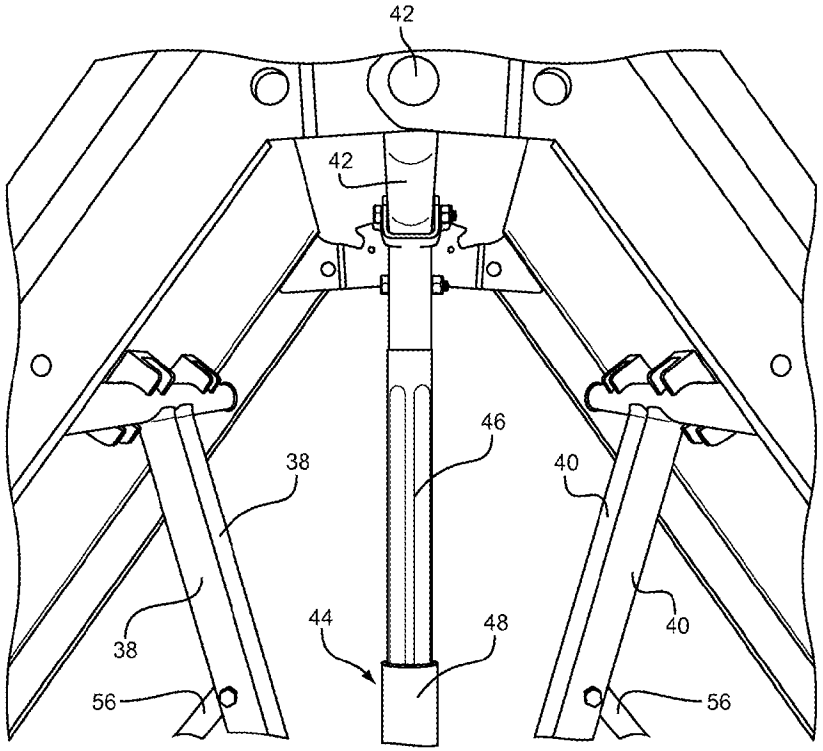
FIG. 4 is a side-bottom perspective view of a center portion of the mobile folding table of FIG. 1 according to the disclosure.

The linkages and mechanics enabling table 10 to be folded will now be described, with reference to FIGS. 2-4. In particular, frame end portions 24 and 26 include table end leg portions 28 and 30 hingedly connected to table top halves 12 and 14, respectively, and bench end leg portions 32 and 34 hingedly connected to benches 18 and 20, respectively. Center portion 22 includes a center leg structure 36, side links 38 and 40 hingedly connected to center leg structure 36, as best seen in FIG. 2, and to table top halves 12 and 14, respectively, as best seen in FIG. 3. To prevent center leg structure 36 from twisting with respect to a table top center bar 42 that hingedly connects table top halves 12 and 14, center leg structure 36 is linked to a center bar 42 by an upper tube 46 of a motorized assembly 44. The upper tube 46 is attached to center bar 42 so as to substantially prevent pivoting of assembly 44 about the axis of center bar 42, as shown in FIG. 3. The upper tube 46 is slidingly connected to a receiver member 48 of the motorized assembly 44. The receiver member 48 being fixedly attached to center leg structure 36.

Figure 5:
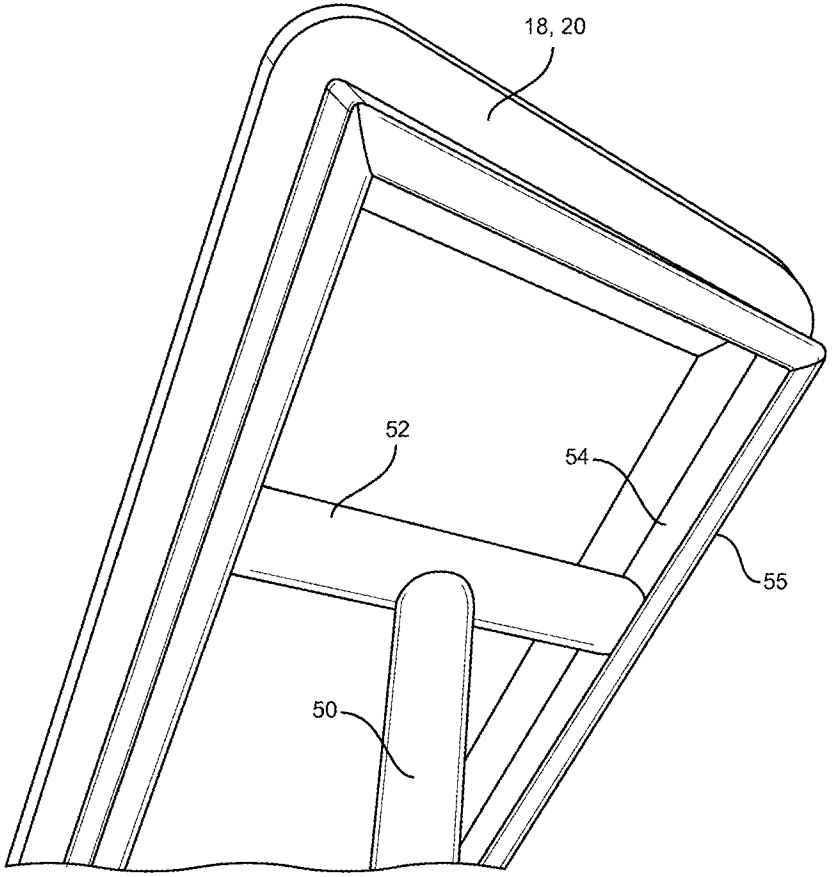
FIG. 5 is a bottom perspective view of a central end portion of a bench of the mobile folding table of FIG. 1 according to the disclosure.

In this manner, four center bench legs 50, which are fixedly attached to center leg structure 36 as shown in FIGS. 1 and 5, are maintained in a substantially upright position whether table 10 is in the unfolded use configuration, in the folded storage configuration, or in the process of being folded or unfolded. Center bench legs 50 are slidingly and pivotally connected to respective benches 18*a* & *b* and 20*a* & *b* by a horizontal cross piece 52 at the top of each bench leg 50, which slidingly and pivotally fits into underside channels 54 defined by underside aprons 55 of each of benches 18 and benches 20, as best illustrated in FIG. 5. Due to center bench legs 50 being kept upright and level at all times, benches 18 and 20 are constrained to mirror each other's folded angle a as shown in FIG. 3, rather than being free to tilt from side to side, which could create an awkward and potentially unsafe storage condition.

Finally, frame 16 includes drive links 56 pivotally connected between side links 38 and 40, respectively, and to end portions 24 and 26, respectively, so as to constrain end portions 24 and 26 to rotate inward slightly during folding, thereby coordinating the folding of end portions 24 and 26 with the folding of center portion 22 and bringing lift-off casters 58 into contact with a floor surface supporting table 10 to facilitate folding and moving table 10.

The disclosure of the present invention uses a motorized assembly for lifting the center of table 10 into the folded storage position or collapsing the center of table 10 into an unfolded use position. Existing folding tables may use one or more torsion bars, springs, or other suitable force-providing mechanisms to aid maintenance personnel in folding or unfolding the table 10. Other existing folding tables known may also employ gas cylinders adapted to exert both spring forces and stabilizing forces that resist rapid extension of the cylinders of the mechanical stabilizer assemblies. Such stabilizing forces are desired in some applications, such as in opening the door of a car trunk, which might otherwise swing open dangerously quickly. The exemplary motorized assembly 44 of the present disclosure comprises an actuator driven by an electrical motor and powered by a portable power source that when the motor is energized provides an axial pushing force to lift the center of table 10 to fold the table into the storage position. The actuator motor can also be energized to have the actuator provide an axial pulling force required to collapse the center of table 10 to unfold the table for use from the storage position. The present disclosure does not rely on the maintenance personnel to physically manipulate the table top 10 to deploy the table 10 to either a storage or to a use position. Deployment of the table to either the folded or storage position or unfolded use position is simply made by manipulating an activating device, such as for example a switch, to energize the actuator motor to drive the motorized assembly 44.

Figure 6:
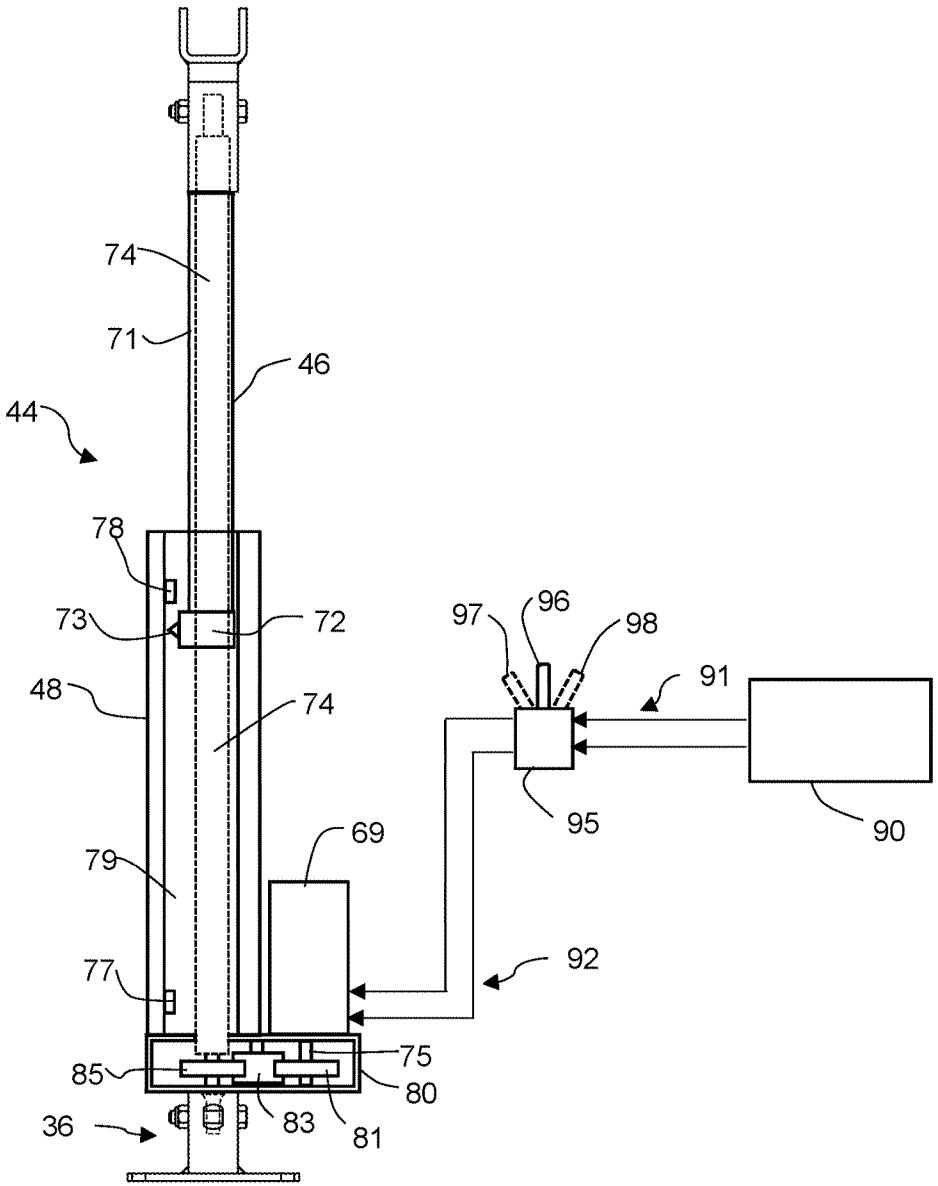
FIG. 6 is a side sectional view of the motorized assembly according to the disclosure.

As shown in FIG. 6, the motorized assembly 44 includes a threaded rod 74 extending through an interior cavity 79 of the receiver member 48 and into an interior cavity 71 of the upper tube 46. The upper tube 46 has an external cylindrical diameter that is arranged to be accepted within a cylindrical interior cavity 79 of the receiver member 48. In this embodiment the upper tube 46 is shown having a cylindrical cross section, it will be appreciated by those skilled in the art that the upper tube 46 may also have other cross sections, such as for example, a square or rectangular cross-section. The interior cavity 79 of receiver member 48 is shaped to accept the particular cross-section of upper tube 46 therein. The interior cavity 79 includes an internally threaded nut 72 threaded on rod 74. Nut 72 is mechanically fixed to an end portion of upper tube 46. Nut 72 travels axially along threaded rod 74 upon rotation of threaded rod 74. Rotation in one direction, for example from left to right, causes the nut 72 to travel axially downward on the threaded rod 74 to pull tube 46 into cavity 79 and receiver member 48. Conversely, rotation of the threaded rod 74 in an opposite direction, for example right to left causes nut 72 to travel axially along threaded rod 74 upward, pushing the upper tube 46 out of cavity 79.

A direct current (DC) electrical motor 69 is mounted on an exterior surface of a gear housing 80. A motor shaft 75 driven by the motor 69 extends into the interior of gear housing 80. A first toothed gear 81 is attached to motor shaft 75. The gear 81 is arranged to be rotated by motor shaft 75. A lower end of receiver member 48 is attached to the exterior surface of gear housing 80 next to motor 69. A portion of the threaded rod 74 extends into the interior of the gear housing 80. A second toothed gear 85 is attached to the portion of the threaded rod 74 extending into gear housing 80. At least one intermediate toothed gear 83 mechanically connects the first gear 81 driven by motor 69 to the second gear 85 attached to the threaded rod 74. Rotational motion of the first gear 81 is transferred to second gear 85 via one or more intermediate gears 83. The intermediate gears may include a plurality of toothed gears in various arrangements to provide gear ratios, based on the speed and torque requirements required to provide sufficient pushing and pulling forces for folding and unfolding the table top 10. As will be understood by those skilled in the art, rotation of the motor 69 causes rotation of the threaded rod 74. Rotation of the motor 69 in one direction causing the upper tube 46 to be contracted into cavity 79 of receiver member 48. The rotation of the motor 69 in another opposite direction causes the upper tube 46 to be extended out of cavity 79 of receiver member 48.

Rotation of the motor 69 and therefore the direction of travel of the upper tube 46 is controlled electrically by providing a voltage at a proper polarity to motor 69. A power source, such as for example a 12 volt or 24 volt battery has its positive and negative terminals connected to a first pair of conductors 91. Conductors 91 are connected to a double pole double throw (DPDT) switching device 95 and from the switching device 95 to terminals on motor 69 via a second pair of conductors 92. With the actuation lever of the switching device 95 in the center position 96 no voltage or current is applied to the motor 69 and therefore the motor is in an off condition. Positioning the lever arm of switching device 95 into position 97 applies voltage and current to cause the motor 69 to rotate in a first direction, causing the upper tube 46 to be contracted into the receiver member 48. Positioning the lever arm into position 98 applied a reverse polarity to the motor 69 causing the motor to rotate in a second direction, causing the upper tube 46 to be extended out of receiver member 48.

The stroke of the upper tube 46, or its travel out of, or into, the receiver member 48 is controlled by internal limit switches 77 and 78 mounted within the cavity 79 and electrically connected to motor 69. A wiper contact 73 is attached to nut 72. As the nut 72 travels on the threaded rod 74 the wiper contact contacts one or the other limit switches 77, 78 based on its direction of travel. For example, when rotation of the threaded rod 74 causes rotation that contracts the tube 46 into cavity 79, the wiper 73 contacts and trips the limit switch 77 causing the motor to stop rotation and defining the lower end of the stroke travel. Upon rotation of the threaded rod 74 that causes the upper tube 46 to be extended out of the receiver member 48, the wiper 73 would trip limit switch 78 stopping motor 69 and any further travel of the upper tube 46 from the receiver member 48, thereby defining the upper limit of stroke travel. The positions of the limit switches 77, 78 within cavity 79 can be placed in various locations in order to control the stroke travel of upper tube 46.

Figure 7:
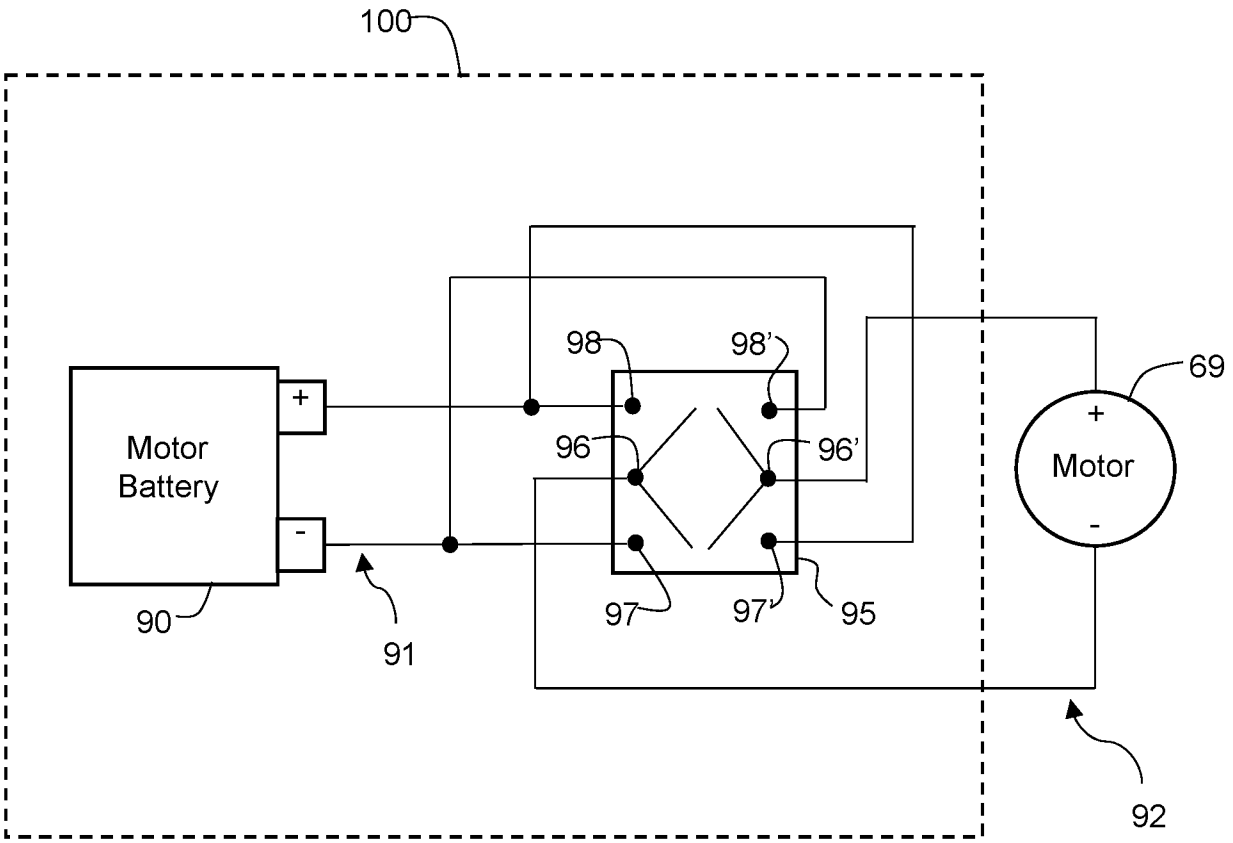
FIG. 7 is a schematic of an electrical circuit for activating the motorized assembly according to a first embodiment of the disclosure.

FIG. 7 is an exemplary schematic of the electrical circuit of a first embodiment for energizing the motor 69 of the motorized assembly 44. A power source such as for example a 12-volt or 24-volt motor battery 90 has its positive and negative terminals connected to a first pair of conductors 91. Conductors 91 are connected to the DPDT switching device 95 and from the DPDT switching device 95 to the terminals on motor 69 via a second pair of conductors 92. The positive lead of the motor 69 is connected to pole 96' of the DPDT switching device 95 and the negative lead of motor 69 to pole 96 via conductors 92. With the actuation lever of switching device 95 in the center position no voltage or current from motor battery 90 is applied to the motor 69 and therefore the motor is in an off condition. Positioning the lever arm of DPDT switching device 95 into position 97 connects the positive terminal of motor battery 90 and terminal 97' to the positive lead of motor 69 via pole 96' and the negative terminal of motor battery 90 and terminal 97 to the negative lead of the motor 69 via pole 96, completing an electrical circuit between the motor battery 90 and the motor 69 causing the motor to rotate in the first direction. Positioning the lever arm of the switching device 95 into position 98 connects the negative terminal of motor battery 90 to terminal 98' and to the positive lead of motor 69 via pole 96'. The positive terminal of motor battery 90 is applied to the terminal 98 and to the negative lead of motor 69 via pole 96 completing an electrical circuit between the motor battery 90 and the motor 69 that applies a reverse polarity to the motor 69 causing the motor to rotate in the second direction, opposite the first direction The motor battery 90 is a portable rechargeable power source that can be comprised of a nickel cadmium, nickel metal hydride or of a lithium ion chemical composition. The motor battery 90 is arranged to be removed from the circuit shown in FIG. 7 in order to be charged by a battery charger at a convenient location.

Figure 8:
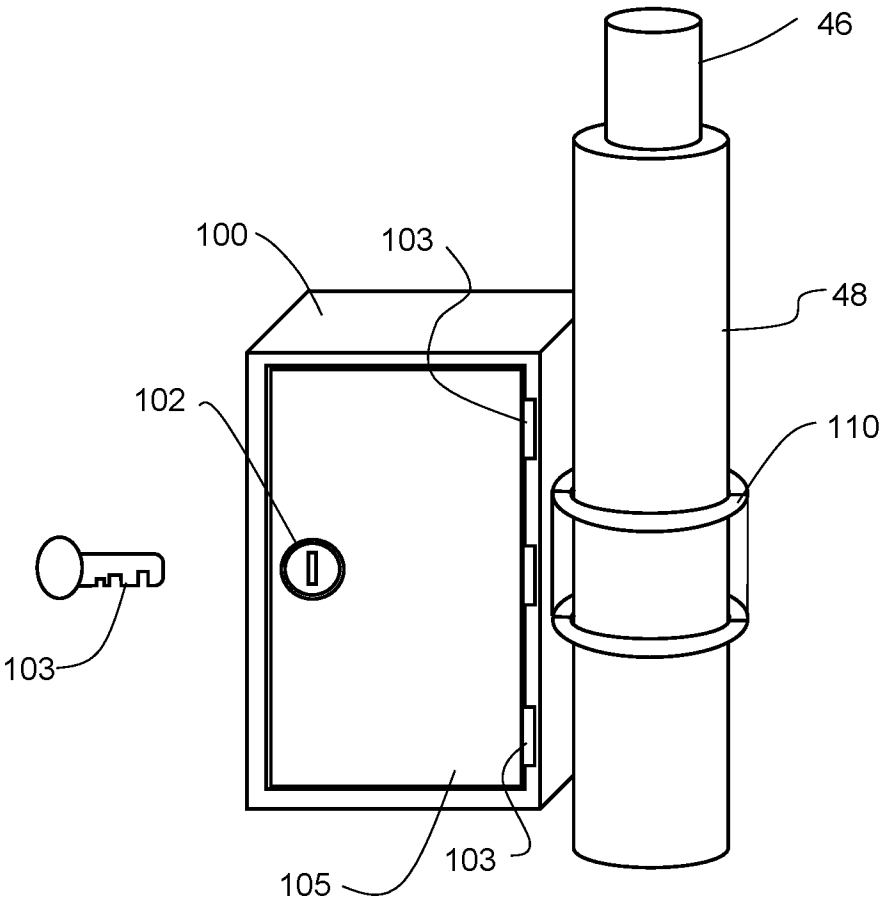
FIG. 8 is a perspective view of an enclosure for housing a power source and switching device used with the motorized assembly of the disclosure.

The exemplary circuit illustrated in FIG. 7 including the switching device 95 and motor battery 90 are preferably housed in an enclosure 100, that can be attached to receiver member 48 of the motorized assembly 44 or to one of the frame members of the folding table 10. FIG. 8 illustrates the enclosure 100 for housing the battery 90, the circuit and switching device 95. The enclosure 100 includes a door 105 fixed to the enclosure via a plurality of hinges 103. The door 105 is arranged to open to allow access to the interior of the enclosure 100 where the battery 90 and switching device 95 are located. An exterior surface of the enclosure 100 includes a mounting bracket 110 that is attached to the enclosure 100 that allows, in this example, the mounting of the enclosure 100 to receiver member 48 of the motor assembly 44. It will be understood by those skilled in the art that the bracket 110 can be mounted on any of the other exterior surfaces of the enclosure 100 to allow the enclosure to be mounted to other frame members supporting the table top 10. The enclosure 100, door 105 and bracket 110 can be comprised of a situatable material such as, for example, a sheet metal or molded from a thermoplastic. A lock 102 is provided for door 105 that can be manipulated to lock or unlock the door 102 using a key 103. This provides a measure of safety to prevent the unauthorized activation of the switching device 95 and tampering with the motor battery 90. Only an authorized maintainer with a key 103 would have access to the interior of the enclosure 100 and to the battery 90 and switching device 95.

Figure 9:
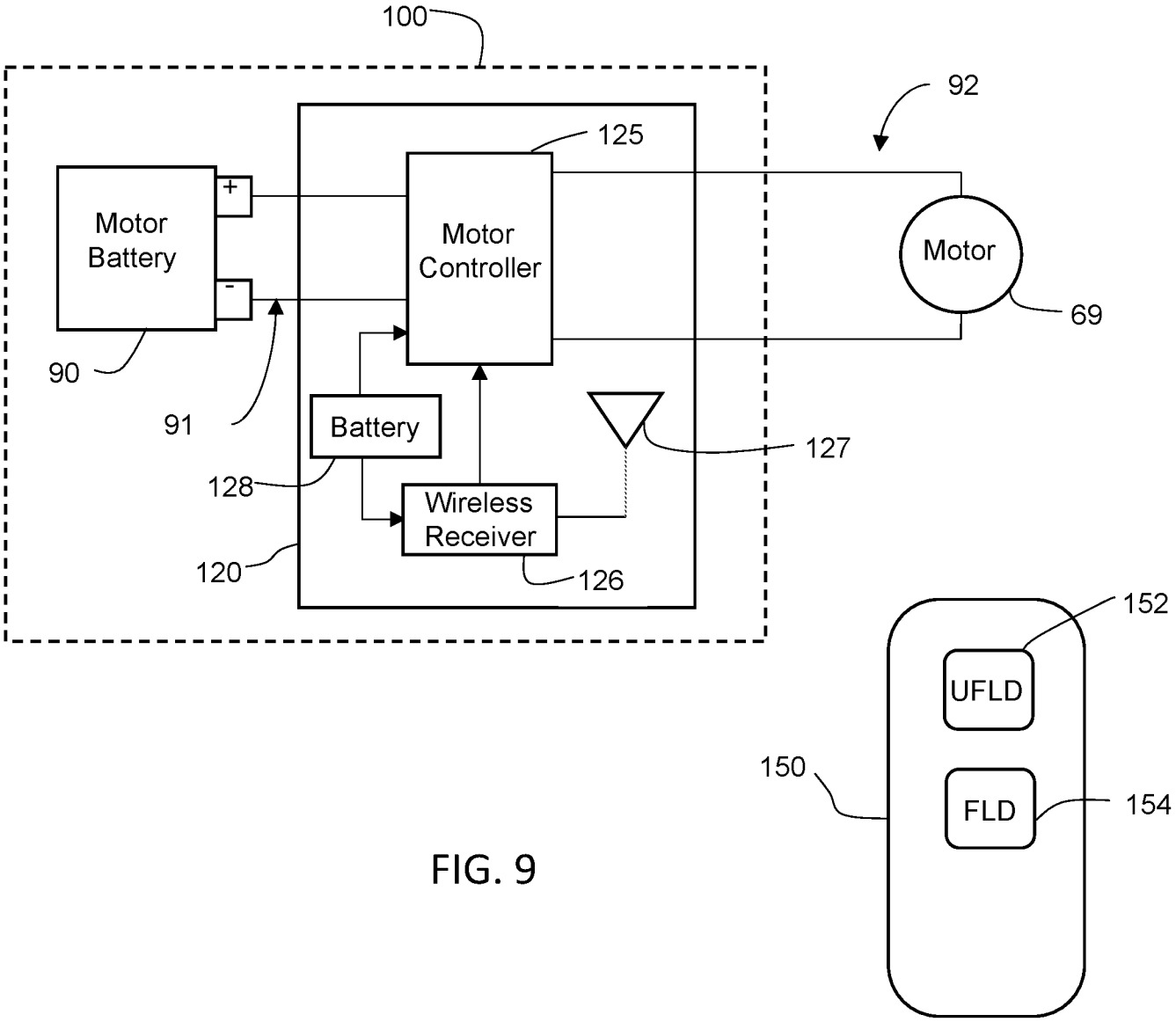
FIG. 9 is a schematic of a wireless electrical circuit for wirelessly activating the motorized assembly according to a second embodiment of the disclosure.

FIG. 9 illustrates schematically a second embodiment for energizing the motor 69 of motorized assembly 44. In the second embodiment a wireless switching device 120 is used to activate the motor 69 of the motor assembly 44. The wireless switching device 120 consists of a wireless receiver 126 connected to an antenna 127 and to a motor controller 125. A secondary battery 128 powers the motor controller 125 and the wireless receiver 126. The motor controller 125 is connected to the motor battery 90 via conductors 91 and to the motor 69 via conductors 92. The wireless switching device 125 and motor battery 90 may be housed within the enclosure 100 shown in FIG. 7.

A handheld wireless remote device 150 includes a first pushbutton 152 and a second pushbutton 154. Pressing either one of pushbuttons 152, 154 transmits a wireless signal to the wireless switching device 120. For example, pushing the "unfold" (UFLD) button 152 transmits a wireless signal to unfold the table 10 and pushing the "fold" (FLD) button 154 transmits a wireless signal to fold the table 10. The wireless signals transmitted from remote device 150 are received by antenna 127 and electrically connected to the wireless receiver 126. The wireless receiver 126 sends the received signals to the motor controller 125. The motor controller 125 identifies and decodes the type of function to be activated sent by the remote device 150. For example, if the UFLD button 152 is pressed, the function for unfolding the table 10 is decoded by the motor controller 125. The motor controller 125 connects the proper voltage polarity to motor 69 from motor battery 90 activating the motorized assembly 44 to contract the upper tube 46 and unfold the table 10 to the unfolded or use position. Similarly, when the FLD button 154 is pressed the wireless device 150 transmits wireless signals that are decoded by the motor controller 125 to apply the proper voltage polarity to the motor 69 to cause the motor assembly 44 to extend the upper tube 46 to fold the table 10 into the folded or storage position. Pressing either button 152, 154 once and releasing the button drives the motor 69 until stopped by the associated limit switch 77, 78. Pressing the same button a second time would stop the rotation of the motor 69 before completing the fold or unfold cycle. This is a safety feature that allows the maintainer to stop the operated cycle due to an obstruction or other situation requiring the motion of the motor assembly 44 to stop immediately. Pressing the same button again would resume the cycle.

Any currently known wireless system for transmitting signals between a remote hand held device and a wireless receiver may be used in the wireless switching device 120, such as for example, a radio frequency (RF) transmitter and receiver combination operating on a radio frequency band, such as those used for a garage door opener, a Bluetooth wireless transmission systems used to transmit control signals between a remote handheld device and a receiver, or a wireless fidelity (Wi-Fi) system using a wireless router or a gateway of a wireless local area network that sends and receives wireless signals between devices.

Table 10 also preferably includes a suitable locking mechanism which may be engaged to lock the linkages of at least one of frame center portion 22 and frame end portions 24 and 26 when table 10 is in its unfolded use position, thus preventing undesired folding of table 10. In the illustrated embodiment, for example, a locking mechanism 60 includes a locking bar 62, pivotally mounted with respect to table top half 14, that may be engaged between notches 64 and 66 of hinge plates 68 and 70, respectively, to lock table 10 is in its unfolded use position. The components of locking mechanism 60 are best seen in FIGS. 2 and 3.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," or "controller" within a claim is understood and intended to refer to structures known to those skilled in the relevant art, as further modified or enhanced by the features of the claims themselves and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A mobile motorized folding table adapted to transition between a folded position and an unfolded position, the mobile motorized folding table comprising:

a first table section hingedly connected to a second table section to permit movement of the first and second table sections about a horizontal hinge axis between the folded position and the unfolded position, wherein the first and second table sections are vertical in the folded position, and wherein the first and second table sections are horizontal in the unfolded position;

links connected to the first and second table sections and configured to articulate with the folding and unfolding of the first and second table sections;

a motorized assembly connected to the links having an upper tube connected to a receiver member for movement of the upper tube from the receiver member between (i) a first position that causes movement of the first and second table sections into the folded position and (ii) a second position that causes movement of the first and second table sections to the unfolded position;

wherein the motorized assembly includes an electrical motor mechanically connected to the upper tube and electrically connected to a switching device and to a source of electrical power; and wherein the table further includes an enclosure housing the switching device and the source of electrical power, the enclosure arranged to be attached to the motorized assembly.

2. The table of claim 1, wherein the enclosure includes a lockable door for providing limited access to the switching device and to the source of electrical power with a key for unlocking the door.

3. The table of claim 2, wherein the source of electrical power is a portable rechargeable battery adapted to be disconnected from the switching device and removed from the enclosure to be charged at another location.

4. The table of claim 1, wherein the motor is operated to connect the motor to receive electrical power at a second polarity from the source of electrical power causing the motor to drive the upper tube into the second position.

5. The table of claim 1, wherein the switching device is a double pole double throw (DPDT) switch.

6. The table of claim 1, wherein the switching device is a wireless switching device.

7. The table of claim 6, wherein the wireless switching device includes a motor controller communicatively connected to a wireless receiver and to the motor, the wireless receiver arranged to receive wireless signals from a handheld remote device, wherein the remote device transmits wireless signals to the wireless receiver to have the motor controller connect the source of electrical power to the motor.

8. The table of claim 7, wherein the remote handheld device includes a first pushbutton that when operated transmits a wireless signal to the wireless switching device that commands the motor controller to connect the motor to receive electrical power at a first polarity from the source of electrical power causing the motor to drive the upper tube into the first position.

9. The table of claim 7, wherein the remote handheld device includes a second pushbutton that when operated transmits a wireless signal to the wireless switching device that commands the motor controller to connect the motor to receive electrical power at a second polarity from the source of electrical power causing the motor to drive the upper tube into the second position.

10. The table of claim 7, wherein the wireless switching device operates using radio frequency (RF) communication signals.

11. The table of claim 7, wherein the wireless switching device operates using Bluetooth communication signals.

12. The table of claim 7, wherein the wireless switching device operates using wireless fidelity Wi-Fi communication signals.

13. The table of claim 1, wherein the switching device is operated to connect the motor to receive electrical power at a first polarity from the source of electrical power causing the motor to drive the upper tube into the first position.

14. A mobile motorized folding table adapted to transition between a folded position and an unfolded position, the mobile motorized folding table comprising:

a first table section hingedly connected to a second table section to permit movement of the first and second table sections about a horizontal hinge axis between the folded position and the unfolded position, wherein the first and second table sections are vertical in the folded position, and wherein the first and second table sections are horizontal in the unfolded position;

links connected to the first and second table sections and configured to articulate with the folding and unfolding of the first and second table sections; and a motorized assembly connected to the links having an upper tube with an internally threaded nut that travels on a threaded rod when the motorized assembly rotates the threaded rod for the movement of the upper tube between (i) a first position that causes movement of the first and second table sections into the folded position and (ii) a second position that causes movement of the first and second table sections to the unfolded position;

wherein the motorized assembly includes an electrical motor mechanically connected to the upper tube and electrically connected to a switching device and to a source of electrical power; and wherein the switching device is a double pole double throw (DPDT) switch.

15. The table of claim 14, wherein the wherein the table further includes an enclosure housing the switching device and the source of electrical power, the enclosure arranged to be attached to the motorized assembly.

16. A mobile motorized folding table adapted to transition between a folded position and an unfolded position, the mobile motorized folding table comprising:

a first table section hingedly connected to a second table section to permit movement of the first and second table sections about a horizontal hinge axis between the folded position and the unfolded position, wherein the first and second table sections are vertical in the folded position, and wherein the first and second table sections are horizontal in the unfolded position;

links connected to the first and second table sections and configured to articulate with the folding and unfolding of the first and second table sections;

a motorized assembly connected to the links having an upper tube connected to a receiver member for movement of the upper tube from the receiver member between an extended and a contracted position;

wherein the links and the first and second table sections collectively provide a pair of connection points for the motorized assembly;

wherein the motorized assembly includes an electrical motor mechanically connected to the upper tube and electrically connected to a switching device and to a source of electrical power; and wherein the switching device is a double pole double throw (DPDT) switch.

17. The table of claim 16, wherein one of the pair of connection points is fixed with respect to the receiver member selected from the links and the other of the pair of connection points being fixed with respect to the upper tube selected from the first and second table sections, the first and second table sections being arranged to fold when the distance between the connection points is extended.

18. The table of claim 16, wherein one of the pair of connection points is fixed with respect to the receiver member selected from the links and the other of the pair of connection points is fixed with respect to the upper tube selected from the first and second table sections, the first and second table sections being arranged to unfold when the distance between the connection points is decreased.

* * * * *